US008756738B2

(12) United States Patent
Luckman et al.

(10) Patent No.: US 8,756,738 B2
(45) **Date of Patent: *Jun. 24, 2014**

(54) WASH CYCLE FOR OXIDIZING AGENTS

(75) Inventors: Joel Adam Luckman, Benton Harbor, MI (US); Michael Stephen Hendrickson, Saint Joseph, MI (US); Tremitchell Wright, Elkhart, IN (US); Katherine E. Warner, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/584,010

(22) Filed: Aug. 13, 2012

(65) Prior Publication Data

US 2013/0219630 A1 Aug. 29, 2013

Related U.S. Application Data

(63) Continuation of application No. 11/744,905, filed on May 7, 2007, now Pat. No. 8,261,391.

(51) Int. Cl.
*D06F 35/00* (2006.01)
*D06F 39/02* (2006.01)

(52) U.S. Cl.
USPC ..... 8/159

(58) Field of Classification Search
USPC ..... 8/158, 159; 68/17 R
See application file for complete search history.

(56) References Cited

U.S. PATENT DOCUMENTS

| | | | | |
|---|---|---|---|---|
| 5,191,669 | A * | 3/1993 | Euler et al. | 8/158 |
| 6,045,588 | A * | 4/2000 | Estes et al. | 8/142 |
| 6,442,980 | B2 * | 9/2002 | Preston et al. | 68/18 R |
| 6,851,148 | B2 * | 2/2005 | Preston et al. | 8/158 |
| 2002/0162177 | A1 * | 11/2002 | Raney et al. | 8/158 |
| 2004/0088796 | A1 * | 5/2004 | Neergaard et al. | 8/158 |
| 2005/0144737 | A1 * | 7/2005 | Roepke et al. | 8/158 |
| 2005/0188731 | A1 * | 9/2005 | Aouad | 68/159 |
| 2005/0241347 | A1 * | 11/2005 | Cho et al. | 68/243 |
| 2005/0252532 | A1 * | 11/2005 | Gray et al. | 134/25.2 |
| 2008/0276380 | A1 * | 11/2008 | De Dominicis et al. | 8/137 |

* cited by examiner

*Primary Examiner* — Joseph L Perrin

(57) ABSTRACT

A wash cycle for a clothes washer with a wash zone defined within a rotating drum having an outer wall, for receiving a fabric load. The steps include dispensing a volume of a first wash liquor to the wash zone, rotating the drum to move the fabric load toward the outer wall and recirculating the first wash liquor through the fabric load and wash zone, all during a first time period. The fabric load is flexed during a second time period. The cycle continues with dispensing a volume of a second, different wash liquor to the wash zone, rotating the drum to move the fabric load toward the outer wall and recirculating the second liquor through the fabric load and wash zone during a third time period. One of the two wash liquors is an oxidizing agent wash liquor. Then the remainder of the wash cycle is completed.

23 Claims, 1 Drawing Sheet

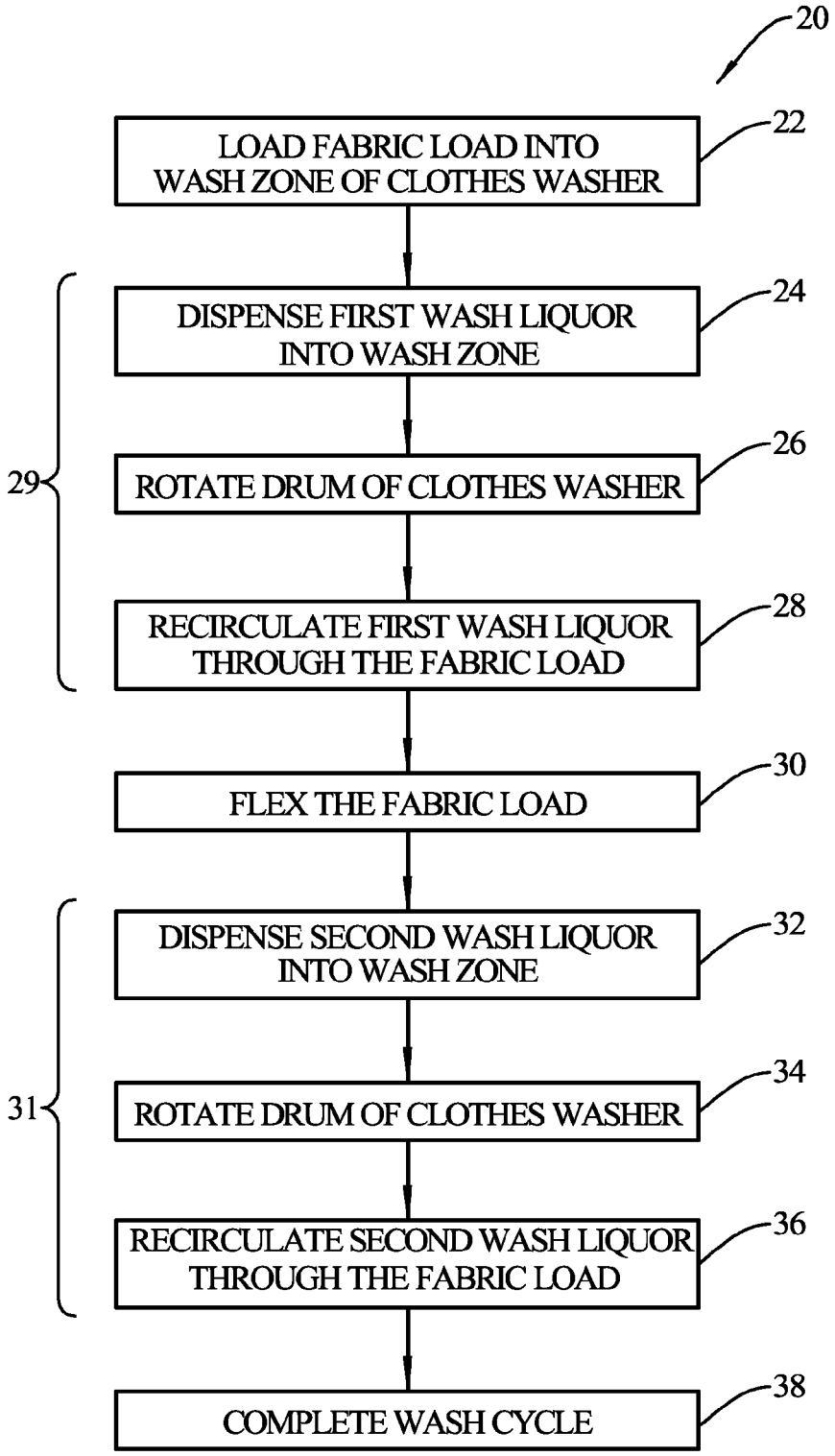
20
LOAD FABRIC LOAD INTO WASH ZONE OF CLOTHES WASHER
22
DISPENSE FIRST WASH LIQUOR INTO WASH ZONE
24
ROTATE DRUM OF CLOTHES WASHER
26
29
RECIRCULATE FIRST WASH LIQUOR THROUGH THE FABRIC LOAD
28
FLEX THE FABRIC LOAD
30
DISPENSE SECOND WASH LIQUOR INTO WASH ZONE
32
ROTATE DRUM OF CLOTHES WASHER
34
31
RECIRCULATE SECOND WASH LIQUOR THROUGH THE FABRIC LOAD
36
COMPLETE WASH CYCLE
38

WASH CYCLE FOR OXIDIZING AGENTS

CROSS REFERENCE TO RELATED APPLICATIONS

This application is a continuation of U.S. patent application Ser. No. 11/744,905, filed May 7, 2007, which is hereby incorporated by reference.

BACKGROUND OF THE INVENTION

In wash cycles for fabric loads, such as for washing clothes in a clothes washer, it is known to use many different detergents and additives to provide various cleaning actions, such as removal of various stains. Even with the numerous detergents and additives available in the market, stain removal is still one of the biggest unmet consumer needs. According to various surveys, consumer dissatisfaction with cleaning performance still ranks high. This dissatisfaction, coupled with recent trends of moving to lower temperatures and lower water volumes during washing cycles only increases the importance of stain removal and cleaning performance.

Various stain removers, such as oxidizing agents, are known and used in wash cycles. However, such oxidizing agents need to be introduced to the wash zone of the washer at specific times relative to the introduction of particular detergents, depending on the individual stains being treated. In some wash cycles, a concentrated detergent solution is applied to the fabric load to increase a cleaning action. However, even this concentrated detergent solution is unable to remove certain types of stains.

The introduction of an oxidizing agent to the wash liquor too early in the wash cycle could defeat the cleaning action or stain removal of some detergents, particularly those that rely on enzyme action to remove protein stains, such as grass stains. Adding an oxidizing agent to a concentrated detergent solution may dilute the concentrated solution too much, or may prevent proper operation of the oxidizing agent. The introduction of an oxidizing agent to the wash liquor too late in the wash cycle could prevent the fabric load from having sufficient contact time with the oxidizing agent to remove certain other stains and provide a complete cleaning action.

It would be an improvement in the art if there were provided a wash cycle utilizing different wash liquors at different times, one of which is an oxidizing agent wash liquor, to enhance the cleaning action and stain removal processes of the washer.

SUMMARY OF THE INVENTION

In an embodiment of the invention, a wash cycle is provided for a clothes washer in which the clothes washer has a wash zone for receiving a load of fabric defined within a rotating drum having an outer wall. The wash cycle includes a step of dispensing a first volume of one of a detergent wash liquor which may be formed at least of water and detergent and an oxidizing agent wash liquor which may be formed at least of water and an oxidizing agent, to the wash zone of the clothes washer.

Another step of the wash cycle is rotating the drum of the washer at a speed sufficient to move the fabric load toward the outer wall of the drum.

Another step of the wash cycle is recirculating the first wash liquor through the fabric load and wash zone for a first period of time.

During a second period of time, the wash cycle includes flexing the fabric load.

Another step of the wash cycle is dispensing a second volume of a different one of a detergent wash liquor formed at least of water and a detergent and an oxidizing agent wash liquor formed at least of water and an oxidizing agent. In an embodiment, the first volume of wash liquor is a detergent wash liquor and the second volume of wash liquor is an oxidizing agent wash liquor. In another embodiment, the first volume of wash liquor is an oxidizing agent wash liquor and the second volume of wash liquor is a detergent wash liquor. In any event, either the first wash liquor or the second wash liquor is an oxidizing agent wash liquor.

Another step of the wash cycle is rotating the drum of the washer at a speed sufficient to move the fabric load toward the outer wall of the drum.

Another step of the wash cycle is recirculating the second wash liquor through the fabric load and wash zone for a third period of time.

Following the third period of time, the remainder of the wash cycle is completed.

During the wash cycle, at least one of the steps of dispensing a volume of detergent wash liquor may comprise adding detergent to the wash zone and subsequently adding water to the wash zone to mix with the detergent. Alternatively, one of the steps of dispensing a volume of detergent wash liquor may comprise adding water to the wash zone and subsequently adding detergent to the wash zone to mix with the water. Also alternatively, one of the steps of dispensing a volume of detergent wash liquor may comprise mixing the detergent with the water prior to adding the detergent wash liquor to the wash zone.

During the wash cycle, one of the steps of dispensing a volume of oxidizing agent wash liquor may comprise adding water to the wash zone and subsequently adding an oxidizing agent to the wash zone to mix with the water. Alternatively, one of the steps of dispensing a volume of oxidizing agent wash liquor may comprise mixing the oxidizing agent with the water prior to adding the oxidizing agent wash liquor to the wash zone.

During the wash cycle, at least one of the steps of rotating the drum of the washer may begin before the wash liquor is dispensed to the wash zone.

During the wash cycle, at least one of the steps of recirculating the wash liquor may begin before the dispensing of the wash liquor to the wash zone has been completed.

During the wash cycle, the step of flexing the fabric load may comprise one of agitating, impelling and tumbling the fabric load.

During the wash cycle, the step of completing the remainder of the wash cycle may include one of agitating, impelling and tumbling the fabric load.

During the wash cycle, one or both steps of rotating the drum of the washer may occur at a speed sufficient to hold the fabric load against the outer wall of the drum and to substantially prevent flexing of the fabric load.

In an embodiment of the invention, a wash cycle is provided for a clothes washer. The clothes washer has a wash zone for receiving a load of fabric defined within a rotating drum. The wash cycle includes a step of dispensing a volume of a first wash liquor to the wash zone of the clothes washer, rotating the drum of the washer at a speed sufficient to move the fabric load toward the outer wall of the drum and recirculating the first wash liquor through the fabric load and wash zone, all during a first period of time.

These steps are followed by a step of flexing the fabric load during a second period of time. That step is followed by a step of dispensing a volume of a second, different wash liquor to the wash zone, rotating the drum of the washer at a speed sufficient to move the fabric load toward the outer wall of the drum and recirculating the second liquor through the fabric load and wash zone during a third period of time, one of the two wash liquors being an oxidizing agent wash liquor. These steps are followed by completing the remainder of the wash cycle.

During one embodiment of the wash cycle, the first volume of wash liquor comprises a detergent wash liquor and the second volume of wash liquor comprises an oxidizing agent wash liquor. In another embodiment of the wash cycle, the first volume of wash liquor comprises an oxidizing agent wash liquor and the second volume of wash liquor comprises a detergent wash liquor.

During one embodiment of the wash cycle, the first period of time comprises at least 2 minutes.

During one embodiment of the wash cycle, the second period of time comprises at least 3 minutes.

During one embodiment of the wash cycle, the first wash liquor is maintained in the wash zone while the oxidizing agent or detergent for the second wash liquor is dispensed into the wash zone.

In an embodiment of the invention, a wash cycle is provided for a clothes washer. The washer has a wash zone for receiving a load of fabric defined within a rotating drum having an outer wall. The wash cycle includes steps of dispensing a first volume of a concentrated detergent wash liquor to the wash zone of the clothes washer, rotating the drum of the washer at a speed sufficient to hold the fabric load against the outer wall of the drum to substantially prevent flexing of the fabric and recirculating the first wash liquor through the fabric load and wash zone, all during a first period of time.

After these steps there is a step of flexing the fabric load during a second period of time. After that step the wash cycle includes steps of dispensing a second volume of an oxidizing agent wash liquor to the wash zone, rotating the drum of the washer at a speed sufficient to move the fabric load toward the outer wall of the drum and recirculating the second wash liquor through the fabric load and wash zone during a third period of time. After these steps, the remainder of the wash cycle is completed.

During one embodiment of the wash cycle, one of the first and second wash liquors is an aqueous based wash liquor.

BRIEF DESCRIPTION OF THE DRAWING

The FIGURE is a flow chart diagram of the steps of a wash cycle embodying the principles of the present invention.

DETAILED DESCRIPTION OF THE PREFERRED EMBODIMENTS

In an embodiment of the invention, as illustrated in the FIGURE, a wash cycle 20 is provided for a clothes washer in which the clothes washer has a wash zone for receiving a load of fabric (step 22) defined within a rotating drum having an outer wall. Such clothes washers are well known in the art and include washers with drums that rotate about a vertical axis and having a central agitator, impeller, plunger or nutating plate, washers with drums that rotate about a horizontal axis, with our without projections extending inwardly from the drum wall, and washers with drums that rotate about a tilted axis. The presently disclosed wash cycle may be used with any of these washers.

The wash cycle 20 includes a step 24 of dispensing a volume of a first wash liquor being either a detergent wash liquor or an oxidizing agent wash liquor, to the wash zone of the clothes washer. Another step 26 of the wash cycle 20 includes rotating the drum of the washer at a speed sufficient to move the fabric load toward the outer wall of the drum. Another step 28 of the wash cycle includes recirculating the first wash liquor through the fabric load and wash zone for a first period of time. During one embodiment of the wash cycle 20, the first period of time comprises at least 2 minutes and may extend up to 30 minutes.

The three steps of dispensing 24, rotating 26 and recirculating 28 all occur during a first segment 29 of the wash cycle 20, and may occur in different orders, or overlapping. That is, during the first segment 29, the step 26 of rotating the drum of the washer may begin before the step 24 during which the wash liquor is dispensed to the wash zone. Also, the step 28 of recirculating the wash liquor may begin before the step 24 of dispensing the wash liquor to the wash zone has been completed, and even before the step 26 of rotating the drum has begun. The steps 26, 28 of rotating the drum and recirculating the wash liquor may occur simultaneously or overlapping in duration.

During the step 26 of rotating the drum of the washer, the drum may be rotated at a speed sufficient to hold the fabric load against the outer wall of the drum and to substantially prevent flexing of the fabric load. In other embodiments of the wash cycle 20, during the step 26 of rotating the drum, the drum may be rotated at a speed sufficient only to move the fabric load towards the outer wall of the drum, but insufficient to hold the fabric load against the outer wall, and hence insufficient to prevent flexing of the fabric load.

During a second period of time, the wash cycle 20 includes a step 30 of flexing the fabric load. This second period of time should be at least 3 minutes, and may be up to 10 or 20 minutes. During the step 30 of flexing the fabric load, the fabric load may be subjected to one or more of agitating, impelling, nutating and tumbling. This step 30 of flexing may occur in the presence of the first wash liquor, and so could constitute a continuation of the first segment 29 of the wash cycle, or the first wash liquor might be partially or completely removed before this step begins. The first wash liquor might be recirculated during the step 30 of flexing, or recirculation may be terminated during the flexing.

A second segment 31 of the wash cycle 20 then begins which includes a step 32 which is dispensing a second volume of a different wash liquor into the wash zone. During an embodiment of the wash cycle 20, the first wash liquor is maintained in the wash zone while the oxidizing agent or detergent for the second wash liquor is dispensed into the wash zone. Additional fluid, such as water or other working fluid may be added with the detergent or oxidizing agents to form the second wash liquor. In other embodiments of the wash cycle 20, the first wash liquor is extracted or removed from the wash zone before the second wash liquor is dispensed into the wash zone.

Another step 34 of the second segment 31 of the wash cycle 20 includes rotating the drum of the washer at a speed sufficient to move the fabric load toward the outer wall of the drum. Yet another step 36 of the second segment 31 of the wash cycle 20 includes recirculating the second wash liquor through the fabric load and wash zone for a third period of time. During an embodiment of the wash cycle 20, the third period of time comprises at least 2 minutes and may extend up to 30 minutes.

As with the steps of the first segment 29 of the wash cycle 20, the three steps of dispensing 32, rotating 34 and recirculating 36 of the second segment 31 of the wash cycle may occur in different orders, or overlapping. That is, during the second segment 31, the step 34 of rotating the drum may begin before the step 32 during which the second wash liquor is dispensed to the wash zone. Also, the step 36 of recirculating the wash liquor may begin before the step 32 of dispensing the wash liquor to the wash zone has been completed, and even before the step 34 of rotating the drum has begun. The steps 34, 36 of rotating the drum and recirculating the wash liquor may occur simultaneously or overlapping in duration.

During the step 34 of rotating the drum of the washer, the drum may be rotated at a speed sufficient to hold the fabric load against the outer wall of the drum and to substantially prevent flexing of the fabric load. In other embodiments of the wash cycle 20, during the step 34 of rotating the drum, the drum may be rotated at a speed sufficient only to move the fabric load towards the outer wall of the drum, but insufficient to hold the fabric load against the outer wall, and hence insufficient to prevent flexing of the fabric load.

Following the third period of time in step 36, the remainder of the wash cycle is completed in a step 38. During the step 36 of completing the remainder of the wash cycle may occur at least one of agitating, impelling, nutating and tumbling the fabric load, as well as rinsing and extracting the rinse fluid from the fabric load.

In an embodiment of the wash cycle 20, the first wash liquor may be a detergent wash liquor and the second wash liquor may be an oxidizing agent wash liquor. In another embodiment of the wash cycle 20, the first wash liquor may be an oxidizing agent wash liquor and the second wash liquor may be a detergent wash liquor. In all embodiments of the wash cycle 20, at least one of the first and second wash liquors is an oxidizing agent wash liquor. In some embodiments of the wash cycle 20, either or both of the detergent wash liquor and oxidizing agent wash liquor may be a mixture of water and detergent or water and an oxidizing agent.

As an example of an embodiment of the wash cycle 20, in the first segment 29, an aqueous based concentrated detergent wash liquor may be dispensed into the wash zone in an amount slightly more than that necessary to saturate the fabric load. This wash liquor may have a detergent concentration of 0.5% to 4% by weight, as described in U.S. Pat. Nos. 4,784,666 and 4,987,627, 5,191,669 and 5,219,370 the disclosures of which are incorporated herein by reference. The drum may be rotated in step 26 at a speed sufficient to hold the fabric load against the drum wall, to prevent flexing of the clothes load while the concentrated detergent wash liquor is recirculated through the fabric load. This could continue for at least 2 minutes and up to 10 or 20 minutes. The speed of rotation of the drum would then be slowed so that the fabric load could be flexed, such as by agitation (which would require the addition of water to the wash zone) or tumbling for several (3-10) minutes. Then an oxidizing agent, perhaps in solution with additional water, could be added to the wash zone, while the drum is rotating to move the fabric load towards the wall of the drum (perhaps, but not necessarily at a speed to prevent flexing of the fabric load) and recirculating the wash liquor, that now contains the oxidizing agent, through the fabric load for a time period while the drum is rotating, before completing the remainder of the wash cycle.

The oxidizing agents to be added to the wash zone are active oxygen releasing compounds, e.g., peroxides (peroxygen compounds) such as perborate, percarbonates, perphosphates, persilicates, persulfates, their sodium, ammonium, potassium and lithium analogs, calcium peroxide, zinc peroxide, sodium peroxide, carbamide peroxide, hydrogen peroxide, and the like. These agents also include peroxy acids and organic peroxides and various mixtures thereof.

A peroxy acid is an acid in which an acidic —OH group has been replaced by an —OOH group. They are formed chiefly by elements in groups 14, 15 and 16 of the periodic table, but boron and certain transition elements are also known to form peroxy acids. Sulfur and phosphorus form the largest range of peroxy acids, including some condensed forms such as peroxydiphosphoric acid, $H_4P_2O_8$ and peroxydisulfuric acid, $H_2S_2O_8$. This term also includes compounds such as peroxycarboxylic acids and meta-chloroperoxybenzoic acid (mCPBA).

Organic peroxides are organic compounds containing the peroxide functional group (ROOR'). If the R' is hydrogen, the compound is called an organic hydroperoxide. Peresters have general structure RC(O)OOR. The O—O bond easily breaks and forms free radicals of the form RO. This makes organic peroxides useful for cleaning purposes.

There are four possible descriptions of the oxidizing agent product composition based on concentration. "Ultra concentrated" means that 80 to 100% of the bleach is active. "Concentrated" means that 40 to 79% of the bleach is active. "Bleach with additive" means that 20-40% of the bleach is active. "Cleaning product with bleach" means that less than 25% of the bleach is active.

If the oxidizing agent is being dispensed as a powder and/or as a cake, the particle size affects how fast the material will be dissolved in the wash liquor. The smaller the particle size, the faster the oxidizing agent will be dissolved in the wash liquor. Also, the temperature of the wash liquor will affect the dissolving speed, with colder wash liquor requiring more time for the dissolving to be completed. In cold wash liquor conditions, such as below 15 C, it is preferable for the particle size to be less than 75 microns. If the wash liquor is warm, such as between about 15 C and 25 C, the particle sizes can be larger, such as up to about 200 microns. If the wash liquor is hot, such as above about 25 C, then the particle sizes can be larger still, such as up to about 300 microns.

Oxidizing agents may be combined within a mixture that has a selection of other material, such as one or more of the following: builders, surfactants, enzymes, bleach activators, bleach catalysts, bleach boosters, alkalinity sources, antibacterial agents, colorants, perfumes, pro-perfumes, finishing aids, lime soap dispersants, composition malodor control agents, odor neutralizers, polymeric dye transfer inhibiting agents, crystal growth inhibitors, photobleaches, heavy metal ion sequestrants, anti-tarnishing agents, anti-microbial agents, anti-oxidants, linkers, anti-redeposition agents, electrolytes, pH modifiers, thickeners, abrasives, divalent or trivalent ions, metal ion salts, enzyme stabilizers, corrosion inhibitors, diamines or polyamines and/or their alkoxylates, suds stabilizing polymers, solvents, process aids, fabric softening agents, optical brighteners, hydrotropes, suds or foam suppressors, suds or foam boosters, fabric softeners, antistatic agents, dye fixatives, dye abrasion inhibitors, anti-crocking agents, wrinkle reduction agents, wrinkle resistance agents, soil release polymers, soil repellency agents, sunscreen agents, anti-fade agents, water soluble polymers, water swellable polymers and mixtures thereof.

A particular oxidizing agent to be added to form the oxidizing agent wash liquor could comprise a combination of water with one or more of sodium carbonate, sodium percarbonate, surfactants and enzymes.

During the wash cycle 20, at least one of the steps 24, 32 of dispensing a detergent wash liquor may comprise adding detergent to the wash zone and subsequently adding water to the wash zone to mix with the detergent. Alternatively, one of the steps 24, 32 of dispensing a detergent wash liquor may comprise adding water to the wash zone and subsequently adding detergent to the wash zone to mix with the water. Also alternatively, one of the steps 24, 32 of dispensing a detergent wash liquor may comprise mixing the detergent with water prior to adding the detergent wash liquor to the wash zone. Still another alternative arrangement may be to mix the detergent directly into a recirculation loop for the wash liquor, so that the detergent is not added until the fabric load is wetted and the wash liquor is being recirculated.

During the wash cycle 20, at least one of the steps 24, 32 of dispensing an oxidizing agent wash liquor may comprise adding water to the wash zone and subsequently adding an oxidizing agent to the wash zone to mix with the water. Alternatively, one of the steps 24, 32 of dispensing an oxidizing agent wash liquor may comprise mixing the oxidizing agent with water prior to adding the oxidizing agent wash liquor to the wash zone. Also, the oxidizing agent may be added to the wash liquor as it is being recirculated. That is, the oxidizing agent may be mixed directly into the recirculation loop for the wash liquor, so that the oxidizing agent is not added until the fabric load is wetted and the wash liquor is being recirculated.

The detergent wash liquor may be introduced to the wash zone through a first nozzle or set of nozzles and the oxidizing agent wash liquor may be introduced to the wash zone through a second, separate nozzle or set of nozzles. Two separate recirculation paths can be arranged, one for the detergent wash liquor and another for the oxidizing wash liquor.

Various features of the steps of the wash cycle 20 have been described which may be incorporated singly or in various combinations into a desired wash cycle, even though only certain combinations are described herein. The described combinations should not be viewed in a limiting way, but only as illustrative examples of particular possible combinations of features.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A method for operating a clothes washer in accordance with a selected wash cycle, the clothes washer having a wash zone, defined within a rotating drum having an outer wall, for receiving a load of fabric, comprising the steps:

in a first washing segment of the wash cycle:

dispensing only one of a first one of a detergent wash liquor and an oxidizing agent wash liquor to the wash zone of the clothes washer as a first wash liquor, rotating the drum of the washer at a speed sufficient to move the fabric load toward the outer wall of the drum, and recirculating the first wash liquor through the fabric load and wash zone for a first period of time, then flexing the fabric load for a second period of time, then in a second, subsequent washing segment of the wash cycle and while maintaining the first wash liquor in the wash zone:

dispensing only the other of the detergent wash liquor and the oxidizing agent wash liquor as a second wash liquor into the wash zone to mix with the first wash liquor, rotating the drum of the washer at a speed sufficient to move the fabric load toward the outer wall of the drum, and recirculating the mixed first and second wash liquor through the fabric load and wash zone for a third period of time, then completing the remainder of the wash cycle including the steps of rinsing the fabric load with a rinse fluid and extracting the rinse fluid from the fabric load, wherein during the step in which the oxidizing agent wash liquor is dispensed, there is included the additional step of providing a concentrated oxidizing agent that is 40% to 79% active, and mixing the concentrated oxidizing agent with water to form the oxidizing agent wash liquor.

2. The method of claim 1, wherein at least one of the steps of dispensing comprises dispensing a volume of detergent wash liquor, the step further comprising one of adding detergent to the wash zone and subsequently adding water to the wash zone to mix with the detergent, adding water to the wash zone and subsequently adding detergent to the wash zone to mix with the water, and mixing the detergent with the water prior to adding the detergent wash liquor to the wash zone.

3. The method of claim 1, wherein at least one of the steps of dispensing comprises dispensing a volume of oxidizing agent wash liquor, this step further comprising one of adding water to the wash zone and subsequently adding an oxidizing agent to the wash zone to mix with the water and mixing the oxidizing agent with the water prior to adding the oxidizing agent wash liquor to the wash zone.

4. The method of claim 1, wherein at least one of the steps of rotating the drum of the washer begins before the wash liquor is dispensed to the wash zone.

5. The method of claim 1, wherein at least one of the steps of recirculating the wash liquor begins before the dispensing of the wash liquor to the wash zone has been completed.

6. The method of claim 1, wherein the step of flexing the fabric load comprises one of agitating, impelling and tumbling the fabric load.

7. The method of claim 1, wherein the step of completing the remainder of the wash cycle includes one of agitating, impelling and tumbling the fabric load.

8. The method of claim 1, wherein at least the first step of rotating the drum of the washer occurs at a speed sufficient to hold the fabric load against the outer wall of the drum and to substantially prevent flexing of the fabric load.

9. The method of claim 1, wherein the first wash liquor comprises a detergent wash liquor and the second wash liquor comprises an oxidizing agent wash liquor.

10. The method of claim 1, wherein the first wash liquor comprises an oxidizing agent wash liquor and the second wash liquor comprises a detergent wash liquor.

11. The method of claim 1, wherein the oxidizing agent wash liquor comprises a combination of water and one or more of sodium carbonate, sodium percarbonate, surfactants and enzymes.

12. A method for operating a clothes washer in accordance with a selected wash cycle, the clothes washer having a wash zone defined within a rotating drum having an outer wall, for receiving a load of fabric, comprising the steps:

in a first washing segment of the wash cycle:

dispensing only a first wash liquor to the wash zone of the clothes washer, rotating the drum of the washer at a speed sufficient to move the fabric load toward the outer wall of the drum and recirculating the first wash liquor through the fabric load and wash zone, all during a first period of time, then flexing the fabric load during a second period of time, then in a second, subsequent washing segment of the wash cycle and while maintaining the first wash liquor in the wash zone:

dispensing only a second, different wash liquor to the wash zone to mix with the first wash liquor, rotating the drum of the washer at a speed sufficient to move the fabric load toward the outer wall of the drum and recirculating the mixed first and second liquor through the fabric load and wash zone during a third period of time, one of the wash liquors being a detergent wash liquor and the other of the wash liquors being an oxidizing agent wash liquor with a concentrated oxidizing agent that is 40% to 79% active, then completing the remainder of the wash cycle including the steps of rinsing the fabric load with a rinse fluid and extracting the rinse fluid from the fabric load.

13. The method of claim 12, wherein the first wash liquor comprises a detergent wash liquor and the second wash liquor comprises an oxidizing agent wash liquor.

14. The method of claim 12, wherein the first wash liquor comprises an oxidizing agent wash liquor and the second wash liquor comprises a detergent wash liquor.

15. The method of claim 12, wherein the first period of time comprises at least 2 minutes.

16. The method of claim 15, wherein the second period of time comprises at least 3 minutes.

17. The method of claim 12, wherein the oxidizing agent wash liquor comprises a combination of water and one or more of sodium carbonate, sodium percarbonate, surfactants and enzymes.

18. A method for operating a clothes washer in accordance with a selected wash cycle, the clothes washer having a wash zone defined within a rotating drum having an outer wall, for receiving a load of fabric, comprising the steps:

in a first washing segment of the wash cycle:

dispensing a volume of a detergent wash liquor to the wash zone and recirculating the concentrated detergent wash liquor through the fabric load and the wash zone, in a second, separate washing segment of the wash cycle:

dispensing a volume of an oxidizing agent wash liquor with a concentrated oxidizing agent that is 40% to 79% active to the wash zone, and thereafter completing the remainder of the wash cycle including the steps of rinsing the fabric load with a rinse fluid and extracting the rinse fluid from the fabric load.

19. The method of claim 18, wherein the oxidizing agent wash liquor comprises a combination of water and one or more of sodium carbonate, sodium percarbonate, surfactants and enzymes.

20. The method of claim 18, including the step of rotating the drum of the washer at a speed sufficient to move the fabric load toward the outer wall of the drum and recirculating the concentrated oxidizing agent wash liquor through the fabric load.

21. The method of claim 18, wherein the first washing segment comprises the step of dispensing a volume of only a concentrated detergent wash liquor having a detergent concentration of 0.5% to 4% by weight to the wash zone of the clothes washer, rotating the drum of the washer at a speed sufficient to hold the fabric load against the outer wall of the drum to substantially prevent flexing of the fabric and recirculating the concentrated detergent wash liquor through the fabric load and wash zone, all during a first period of time, then flexing the fabric load during a second period of time.

22. The method of claim 21, wherein the first period of time is at least 2 minutes and the second period of time is at least 3 minutes.

23. The method of claim 21, wherein one of the concentrated oxidizing agent and concentrated detergent wash liquors is an aqueous based wash liquor.

* * * * *